US005503230A

United States Patent [19]

Osborne et al.

[11] Patent Number: 5,503,230

[45] Date of Patent: Apr. 2, 1996

[54] CONCENTRIC TUBING HANGER

[75] Inventors: John H. Osborne; Brett R. McConaughy; Robert O. Lilley; Norman Brammer; Kenneth C. Davidson, all of Aberdeen, Scotland

[73] Assignee: Vetco Gray Inc., Houston, Tex.

[21] Appl. No.: 341,241

[22] Filed: Nov. 17, 1994

[51] Int. Cl.[6] ..... E21B 33/043

[52] U.S. Cl. ..... 166/344; 166/368; 166/321; 166/379

[58] Field of Search ..... 166/77.5, 208, 166/341, 344, 348, 368, 321, 379

[56] References Cited

U.S. PATENT DOCUMENTS

| | | | |
|---|---|---|---|
| 3,279,536 | 10/1966 | Wakefield, Jr. . | |
| 3,339,632 | 9/1967 | Lewis . | |
| 3,543,847 | 12/1970 | Haeber | 166/348 |
| 3,688,841 | 9/1972 | Baugh | 166/85 |
| 3,693,714 | 9/1972 | Baugh | 166/85 X |
| 3,887,520 | 4/1975 | Putnam . | |
| 4,089,377 | 5/1978 | Chateau . | |
| 4,192,384 | 3/1980 | Croy . | |
| 4,209,891 | 7/1980 | Lamb et al. . | |
| 4,363,168 | 12/1982 | Bryer et al. | 166/341 X |
| 4,375,239 | 3/1983 | Barrington et al. . | |
| 4,427,072 | 1/1984 | Lawson . | |
| 4,436,157 | 3/1984 | Brooks . | |
| 4,629,003 | 12/1986 | Baugh . | |
| 4,651,831 | 3/1987 | Baugh . | |
| 4,721,163 | 1/1988 | Davis . | |
| 4,770,248 | 9/1988 | Houlgrave et al. . | |
| 4,848,457 | 7/1989 | Lilley . | |
| 4,852,648 | 8/1989 | Akkerman et al. . | |
| 4,869,318 | 9/1989 | Kellett . | |
| 4,903,774 | 2/1990 | Dykes et al. . | |
| 4,958,686 | 9/1990 | Dutch | 166/348 |
| 5,076,356 | 12/1991 | Reimert . | |
| 5,143,158 | 9/1992 | Watkins et al. | 166/344 |
| 5,145,006 | 9/1992 | June | 166/341 |
| 5,161,620 | 11/1992 | Ritter, Jr. . | |

*Primary Examiner*—Frank S. Tsay
*Attorney, Agent, or Firm*—James E. Bradley

[57] ABSTRACT

A subsea well assembly has guides for orienting electrical connectors located on a concentric tubing hanger and on the tree. The guides use a guide slot and key to rotate the electrical connectors on the lower end of the tree when the tree is installed on the wellhead. The tree electrical connectors are located on the upper guide member and rotate relative to the tree as the guide slot engages the guide key. An annulus valve in the tubing hanger uses a sleeve with inner and outer metal seal lips.

25 Claims, 4 Drawing Sheets

CONCENTRIC TUBING HANGER

BACKGROUND OF THE INVENTION

1. Field of the Invention

This invention relates in general to subsea wellhead assemblies and in particular to a subsea wellhead assembly utilizing a concentric tubing hanger and in which installation is accomplished without requiring orientation of the tubing hanger or the tree.

2. Description of the Prior Art

In the offshore wells of the typed concerned herein, a subsea wellhead will be located at the sea floor. Two or more strings of well casing will be supported by casing hangers which land and seal within the wellhead housing. Subsequently, a string of production tubing is lowered through the casing to be used for producing fluids from the well. A tubing hanger located at the upper end of the string of tubing lands in the uppermost casing hanger. A production tree is then lowered onto the wellhead housing, the tree having various valves for controlling the produced fluids.

It is necessary for the tubing hanger to have a passage that leads to the annulus surrounding the tubing. In the most common type of tubing hanger, the annulus passage and the production passage extend through the tubing hanger parallel with but offset from the longitudinal axis of the tubing hanger. The production tree will have a production stinger for connecting its production bore with the production bore in the tubing hanger, and an annulus stinger for the stabbing into the annulus bore.

It is also common to have electrical connectors or penetrators that extend through the tubing hanger. The electrical connectors connect downhole instruments to the vessel at the surface for measuring pressure, temperature and the like. Normally, an electrical connector is located on the upper end of the tubing connector for mating with electrical connectors protruding downward from the lower end of the tree.

During installation, because of the offset production and annulus bores and the electrical penetrators, the tubing hanger will be oriented relative to the subsea wellhead housing. The tree also will be oriented so that the electrical connectors and the stingers will make up as the tree lands on the wellhead housing. In deep water, the orientation to the desired degree can be difficult.

In another type of tubing hanger, the production bore in the tubing hanger is coaxial with the longitudinal axis of the tubing hanger and the wellhead housing. In this type, known as a concentric tubing hanger, the production stinger from the tree needs no orientation. Also, the annulus passage in the tubing hanger may have a concentric valve sleeve, avoiding the need for orienting an annulus stinger of the tree with an annulus bore. However, if electrical penetrators are employed through the tubing hanger, orientation is still required for these connectors. In deep water, the orientation can still be a problem with concentric tubing hangers. Also, sealing for the annulus valves can be troublesome.

SUMMARY OF THE INVENTION

In this invention, a concentric tubing hanger is employed. The tubing hanger has at least one electrical connector located on its upper end, offset from the axis. The tubing hanger is installed without orientation. It has a guide member mounted to it that faces upward.

The tree has an upper guide member that depends downward from the lower end. At least one electrical connector is mounted to the upper guide member, offset from the longitudinal axis of the tree. A helical guide slot is formed in one of the guide members. A guide pin is located on the other guide member for engaging the guide slot. The engagement causes the upper guide member to rotate and orient with the tree electrical connector with the tubing hanger electrical connector. Preferably, the upper guide member rotates relative to the tree.

The tubing hanger has a concentric annulus valve. The annulus valve comprises a sleeve mounted concentrically within an annular valve chamber in the tubing hanger. A lower annulus passage extends up to a lower portion of the valve chamber. An upper annulus passage joins the valve chamber. The valve sleeve moves between an upper open position and a lower closed position. Metal inner and outer lips are formed on the lower end of the valve sleeve for sealing against a tapered portion formed in the annular valve chamber. Springs bias the valve sleeve to the closed position. Hydraulic fluid pressure supplied from the stinger is used to move the valve sleeve to the open position.

DETAILED DESCRIPTION OF THE INVENTION

Figure 1:
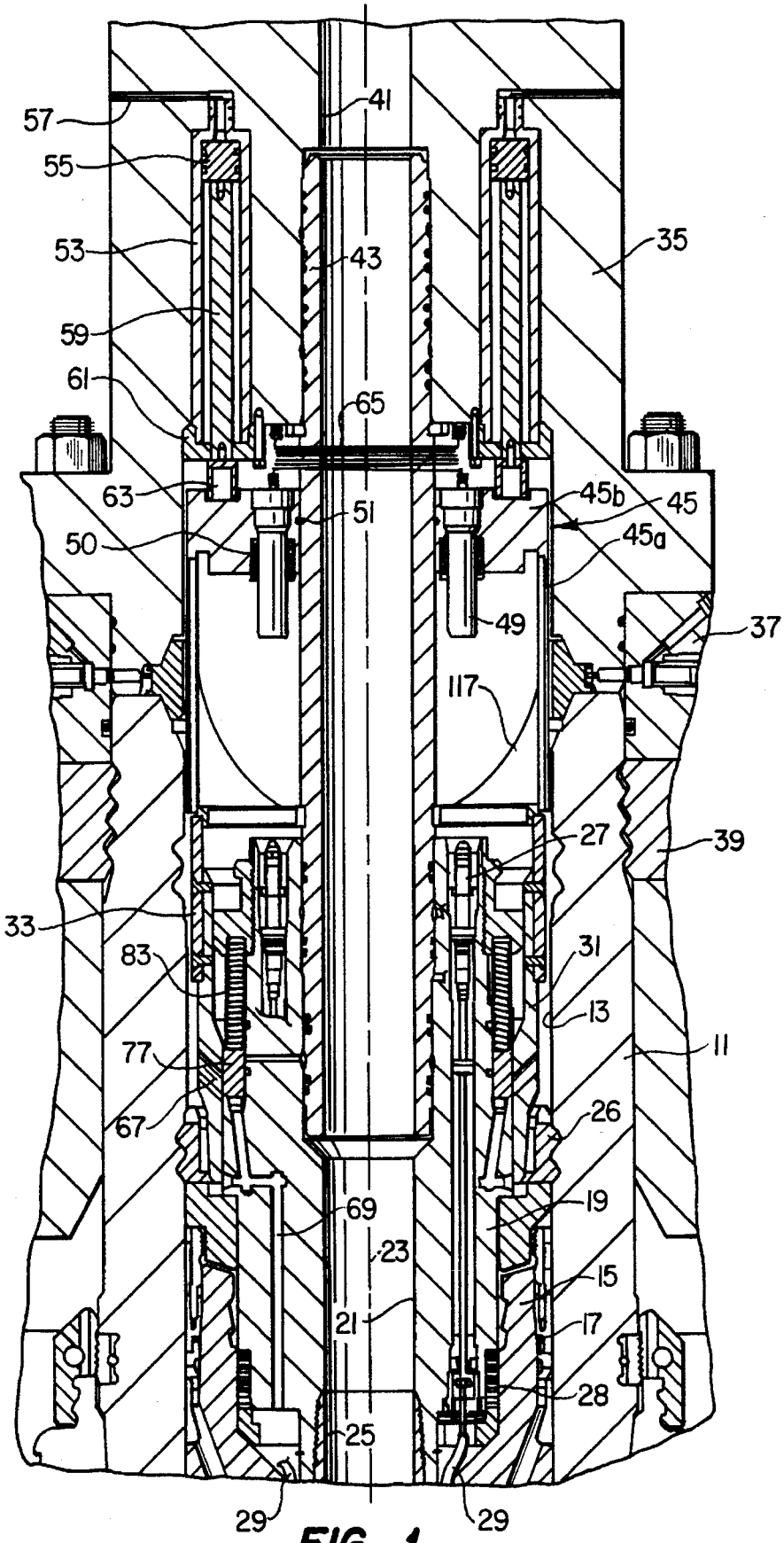
FIG. 1 is a sectional view illustrating a portion of a subsea wellhead assembly constructed in accordance with this invention and showing the upper guide member in an upper position.

Referring to FIG. 1, the wellhead housing 11 will be supported at the sea floor. Wellhead housing 11 has a bore 13. Multiple strings of casing (not shown) extend into the well. The smallest diameter casing is supported by casing hanger 15, which lands in bore 13 and is sealed by casing hanger seal 17.

A tubing hanger 19 will be installed within wellhead housing 11. Tubing hanger 19 has a production passage 21, which is coaxial with the longitudinal axis 23 of wellhead housing 11. Tubing hanger 19 is thus of a concentric type and is secured to a string of tubing 25 that extends through the casing into the well. Produced fluids will flow up the tubing 25 and production passage 21. A lock ring 26 on the exterior of tubing hanger 19 is expanded out to secure tubing hanger 19 to wellhead housing 11. A seal 28 on the lower portion of tubing hanger 19 seals tubing hanger 19 to a bowl of casing hanger 15.

In the embodiment shown, tubing hanger 19 has two electrical penetrators or connectors 27. Each electrical connector 27 is located at the upper end of the tubing hanger 19 and faces upward, parallel with the longitudinal axis 23. Each electrical connector 27 includes a receptacle and connects to a wire 29 that extends downward to an instrument (not shown) such as a pressure or temperature gage. Electrical connectors 27 and wires 29 extend sealingly through holes formed in tubing hanger 19.

Tubing hanger 19 has a guide member 31 which also serves for pushing lock ring 26 outward into recesses located in wellhead housing bore 13. Guide member 31 is a sleeve that slides between an upper position and a lower position shown, and is a part of the tubing hanger assembly. Guide member 31 has at least two alignment keys 33. Each alignment key 33 is a rectangular member protruding upward, evenly spaced 180 degrees apart from each other.

The master valve block of a production tree 35 is shown landed on wellhead housing 11. A wellhead connector 37 is mounted to tree 35 and extends around the exterior of wellhead housing 11. Connector dogs 39 are moved inward to engage grooves on the exterior of wellhead housing 11 to lock tree 35 to wellhead housing 11. Tree 35 has a flow passage 41 that is coaxial with longitudinal axis 23 once landed on wellhead housing 11. A stinger 43 locates at the lower end of flow passage 41 and protrudes downward. Stinger 43 is a tube that inserts into a counterbore formed in tubing hanger production passage 21.

Figure 5:
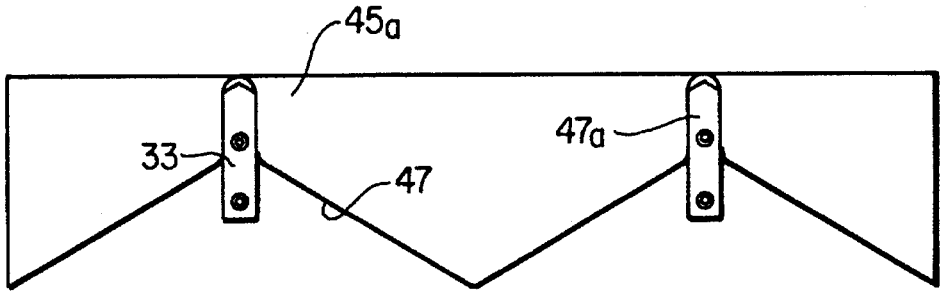
FIG. 5 is a schematic flattened side view of the upper guide member, illustrating the interaction of the upper guide member with the alignment keys for the wellhead assembly of FIG. 1.

An upper guide member 45 is carried by tree 35. Upper guide member 45 has a sleeve portion **45*a* that encircles stinger 43 coaxial with axis 23. An upper plate portion 45*b* locates at the top of upper guide member 45, plate portion 45*b* being perpendicular to axis 23. Upper guide member 45 has two helical guide slots 47 in its sleeve portion 45*a*, forming a "mule shoe" for engagement with alignment keys 33. As shown in FIG. 5, slots 47 have vertical portions 47*a* at the upper ends of the helical portions. The vertical portions 47*a* are sized for close reception over the alignment keys 33. Upper guide member 45 will move between an upper retracted position relative to tree 35, shown in FIG. 1, to a lower extended position shown in FIG. 2**.

Two tree electrical connectors 49 are mounted to plate portion **45*b* of upper guide member 45. Tree electrical connectors 49 are positioned for mating with the tubing hanger electrical connectors 27. Tree electrical connectors 49 are offset from stinger 43 and spaced from each other. Each tree electrical connector 49 protrudes downward from plate portion 45*b* and is biased downward from plate portion 45*b* by a series of conical Belleville washers or springs 50, half of which are inverted relative to the other half. Plate portion 45*b* has a central hole 52 for close reception of stinger 43. A seal 51 located in hole 52 fictionally engages stinger 43 to releasably hold upper guide member 45** in the upper position.

The apparatus for moving upper guide member 45 to the lower position includes a plurality of cylinders 53 (two shown). Cylinders 53 are located in bores formed in tree 35 parallel to and spaced around tree flow passage 41. A piston 55 is carried within each cylinder 53. Hydraulic fluid passages 57 will supply hydraulic fluid from the drilling or production vessel (not shown) down a line (not shown) to the upper side of each piston 55. A rod 59 extends downward from each piston 55 for movement therewith. Rods 59 are square, each extending through a square aperture in a retainer plate 61. The square rods 59 prevent rotation of pistons 55 relative to cylinders 53. A roller 63 is rotatably mounted to the lower end of each rod 59. Rollers 63 engage the upper side of plate portion **45*b* of upper guide member 45. Rollers 63 serve as a bearing means for allowing rotation of upper guide member 45 relative to rods 59**.

Figure 2:
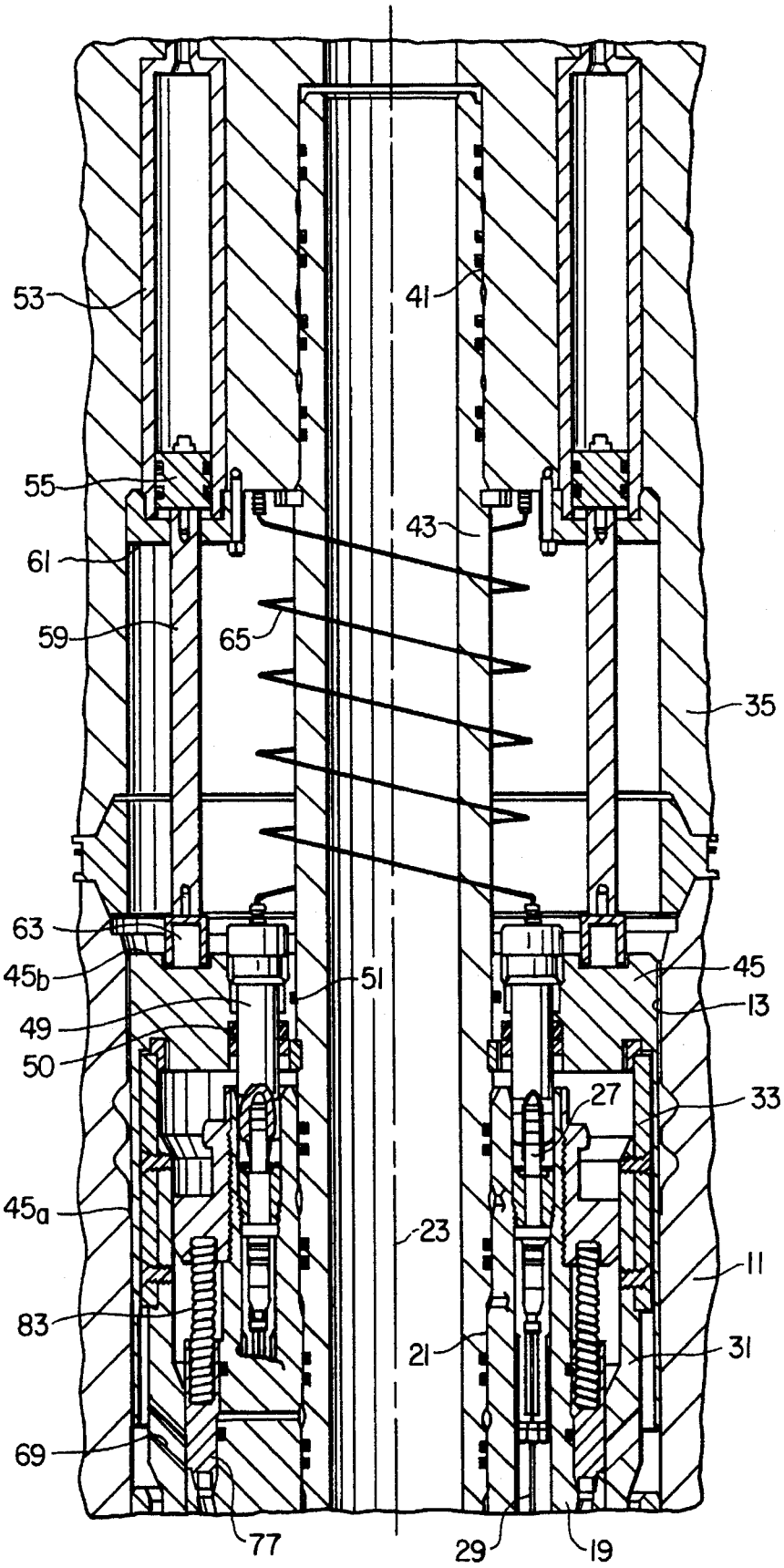
FIG. 2 is a sectional, enlarged, partial view of the wellhead assembly of FIG. 1, but showing the upper guide member moved to a lower position in engagement with the tubing hanger electrical connectors.

Wires 65 extend from the lower end of tree 35 to each of the electrical connectors 49. Wires 65 are wrapped around stinger 43. A sufficient amount of wire 65 is provided to allow for the extension downward of upper guide member 45 as shown in FIG. 2. The upper ends of wires 65 are connected to wires (not shown) that lead to the production vessel for monitoring pressure and temperature in the well.

Figure 3:
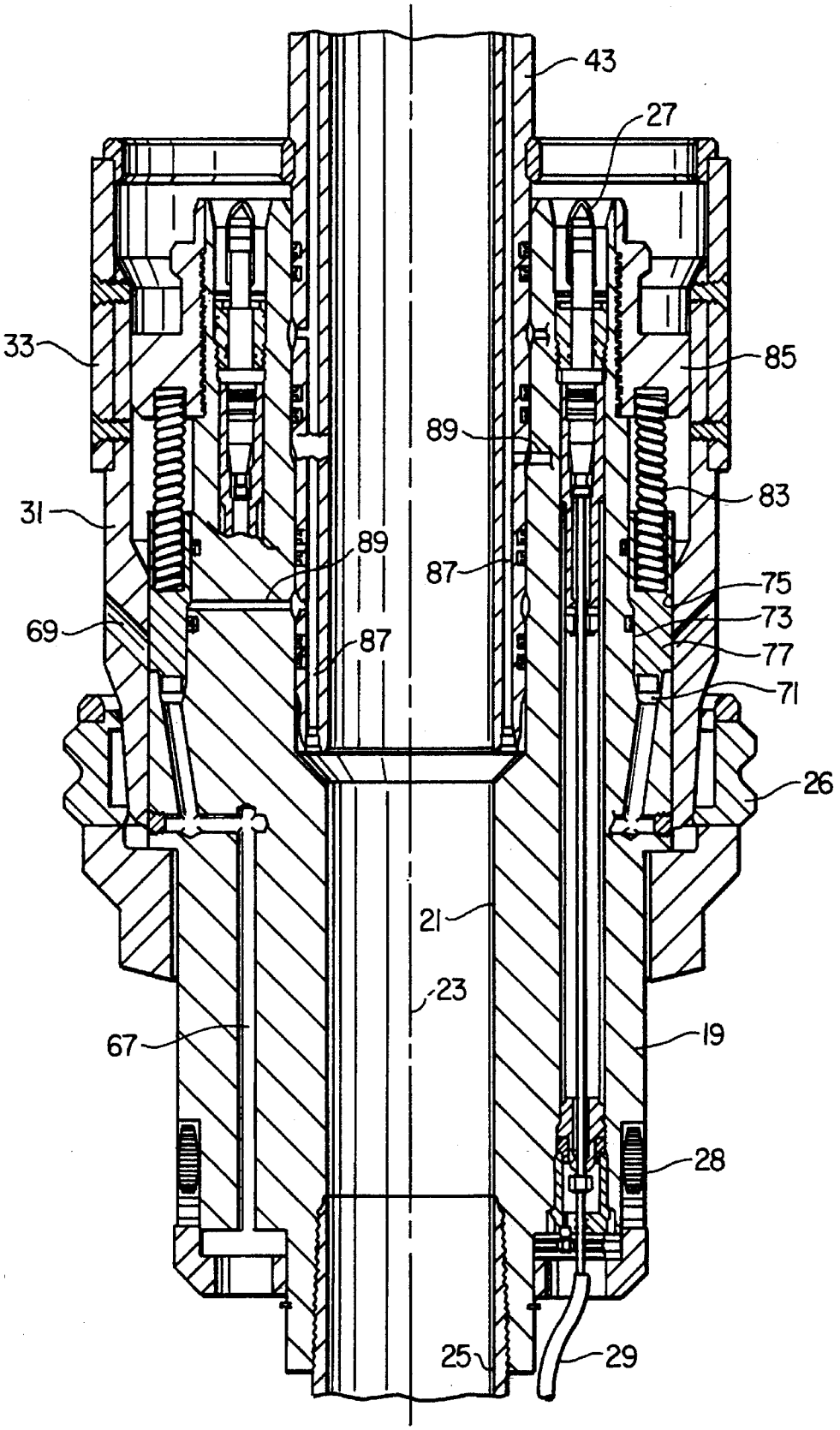
FIG. 3 is a sectional, partial, enlarged view of the tubing hanger of the wellhead assembly of FIG. 1, shown removed from the wellhead and with the annulus valve in a closed position.

Referring to FIG. 3, tubing hanger 19 has a plurality of lower annulus passages 67 (only one shown). Each annulus passage 67 extends from the lower end of tubing hanger 19 upward a select distance, offset from production passage 21. Each lower annulus passage 67 communicates with the annulus surrounding tubing 25 (FIG. 1). A plurality of upper annulus passages 69 (only two shown) extend through guide member 31 of tubing hanger 19. Each upper passage 69 leads to the bore 13 of wellhead housing 11 (FIG. 1) at a point above casing hanger seal 17 and tubing hanger seal 28.

Figure 4:
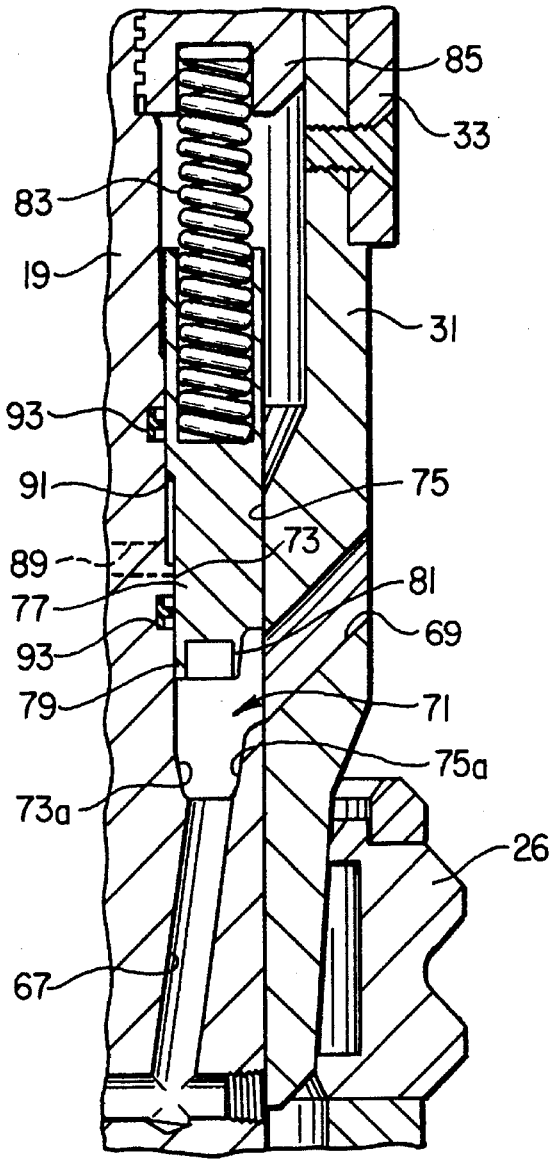
FIG. 4 is a sectional, partial, enlarged view of the tubing hanger as illustrated in FIG. 3, but showing the annulus valve in an open position.

An annular valve chamber 71 is located within the assembly of tubing hanger 19, defined on its inner side by an inner wall 73. The outer wall 75 of valve chamber 71 is also an inner wall of guide member 31. Each wall 73, 75 has a tapered lower seal area **73*a*, 75*a*, as shown in FIG. 4. The tapered seal areas 73*a*, 75*a* converge toward each other and terminate at the base of valve chamber 71. Valve chamber 71 is intersected at its base by the lower annulus passages 67 and intersected along outer wall 75 by upper annulus passages 69**.

A valve sleeve 77 is sealingly carried within valve chamber 71 for selectively opening and blocking flow between the annulus passages 67, 69. Valve sleeve 77 is a cylindrical member that is coaxial with axis 23. As shown in FIG. 4, an inner lip 79 protrudes downward from the lower end of the inner side wall of valve sleeve 77. An outer lip 81 protrudes downward from the lower end of the outer side wall of valve sleeve 77. Lips 79, 81 are integrally formed with the metal valve sleeve 77, and are tapered downward and flexible for slidingly engaging the tapered sealing areas **73*a*, 75*a* when in the lower position. When valve sleeve 77 moves to the lower position, the tapered areas 73*a*, 75*a* deflect lips 79, 81** inward to cause a metal-to-metal seal.

A plurality of coil springs 83 urge valve sleeve 77 downward to the closed position. Springs 83 are spaced around the circumference of valve sleeve 77. The upper end of each of these springs 83 engages a retainer 85. Retainer 85 is a threaded ring that mounts rigidly to tubing hanger 19, as shown in FIG. 3.

A hydraulic means is employed to move valve sleeve 77 to the upper position, compressing springs 83. This hydraulic means includes two stinger hydraulic passages 87, shown in FIG. 3. Passages 87 extend axially within the length of stinger 43, registering with hydraulic passages (not shown) in tree 35 (FIG. 1). For clarity, the hydraulic passages 87 are not shown in FIGS. 1 and 2. The hydraulic passages 87 join radial passages 89 in tubing hanger 19. The lower radial passage 89 joins one passage 87 and leads to valve chamber 71, as shown in FIG. 4. The upper radial passage 89 joins the other passage 87 and serves as a return. Valve sleeve 77 has a shoulder 91 (FIG. 4) on its inner wall to serve as a piston for moving valve sleeve 77 upward when hydraulic fluid pressure is supplied through the lower passage 89 to the lower side of shoulder 91. Seals 93 on the tubing hanger 19 are sealingly engaged by valve sleeve 77 to provide a pressure chamber to accomplish the movement to the upper position.

In operation, during drilling, casing will be installed in the well and casing hanger 15 landed in place. After cementing, casing hanger seal 17 will be installed. Typically, there will be at least two casing hangers, each supporting a string of casing. Then, a string of tubing 25 will be made up and lowered into the well. Pressure and temperature sensors will be located in the string of tubing 25, along with other production equipment. These sensors will be connected by wires 29 to the tubing hanger electrical connectors 27.

The tubing hanger 19 will be lowered into wellhead housing 11 with lower guide member 31 in an upper position and lock ring 26 retracted. There will be no need to orient tubing hanger 19 nor electrical connectors 27 in any particular orientation as tubing hanger 19 is lowered into wellhead housing 11. Once tubing hanger 19 lands in the bowl of casing hanger 15, casing hanger 15 will support tubing hanger 19. The running tool (not shown) for tubing hanger 19 will then move guide member 31 downward, pushing lock ring 26 into the outer position.

The operator will then lower tree 35 onto wellhead housing 11. Stinger 43 will be located in flow passage 41, and upper guide member 45 will held in the upper position shown in FIG. 1. Tree 35 will be lowered onto wellhead housing 11 without any particular orientation. As it reaches contact with wellhead housing 11, stinger 43 will stab into production passage 21. Once landed on wellhead housing 11, hydraulic means (not shown) will move dogs 39 into engagement with the grooves in wellhead housing 11.

Then, the operator will supply hydraulic fluid pressure from the vessel to the passages 57. This moves pistons 55 downward. The rollers 63 push the upper guide member 45 downward, overcoming the friction of seal 51. The guide slots 47 will engage the alignment keys 33 during this downward movement. This causes rotation of upper guide member 45 relative to tree 35 and also relative to tubing hanger 19. Rollers 63 rotate against the upper plate portion **45*a* of upper guide member 45. As upper guide member 45 rotates, tree electrical connectors 49 will rotate in unison with upper guide member 45. The guide slots 47 will cause the tree electrical connectors 49 to orient into alignment with the tubing hanger electrical connectors 27 due to the placement of the alignment keys 33**.

Before the tree electrical connectors 49 touch the tubing hanger electrical connectors 27, the alignment keys 33 will reach the vertical portion **47*a* (FIG. 5). When keys 33 are at the entrances of the vertical portions 47*a* of guide slots 47, the electrical connectors 49 and 27 will be in alignment. Continued downward movement due to the hydraulic fluid pressure supplied to pistons 45 then moves tree electrical connectors 49 down into full engagement with tubing hanger electrical connectors 27. Belleville washers 50 compress during the final travel and result in a desired preload between the male and female halves of the electrical connectors 49, 27. The electrical continuity will now be established from wire 29, through the connectors 27, 49 and through the wires 65** to the surface vessel.

In this position, valve sleeve 77 will be in the closed position due to the force of springs 83. To open the annulus passages 67, 69 (FIG. 3) the operator supplies hydraulic fluid pressure through one of the stinger hydraulic fluid passages 87. This pressure acts on shoulder 91, moving valve sleeve 77 to the upper position shown in FIG. 4. In this position, lower annulus passage 67 will be in fluid communication with upper annulus passage 69. Upper annulus passage 69 communicates with the interior space surrounding stinger 43 (FIG. 1), this space having a port and valve (not shown) for controlling and monitoring the annulus.

Hydraulic fluid pressure must be maintained in hydraulic passages 87 and 89 against shoulder 91 to maintain valve sleeve 77 in the open position. Should hydraulic pressure fail or be removed, springs 83 will force valve sleeve 77 back to the closed position. Should tree 35 be removed for working on the well, the hydraulic fluid pressure will be removed before removing stinger 43 from tubing hanger production bore 21.

The invention has significant advantages. The upper and lower guide members provide a means for orienting electrical connectors of a concentric tubing hanger without having to orient the tubing hanger. Being able to avoid orienting the tubing hanger and tree is particularly useful for deep water installations. The annulus valve provides an effective seal through the metal seal lips.

While the invention has been shown in only one of its forms, it should be apparent to those skilled in the art that it is not so limited, but is susceptible to various changes without departing from the scope of the invention.

We claim:

1. In a subsea well assembly having a subsea wellhead housing, a tubing hanger landed within the wellhead housing and having a longitudinal axis, at least one tubing hanger electrical connector located on an upper end of the tubing hanger and offset from the longitudinal axis, and a tree which mounts to an upper end of the wellhead housing; the improvement comprising:

an upper guide member carried by and depending downward from a lower end of the tree;

at least one tree electrical connector mounted to the upper guide member, offset from a longitudinal axis of the tree and protruding downward;

lower guide member mounted to the tubing hanger;

a helical guide slot formed in one of the guide members; and a guide key located on the other guide member for engaging the guide slot to orient the tree electrical connector with the tubing hanger electrical connector by moving the upper guide member into engagement with the lower guide member as the tree is installed on the wellhead housing.

2. The wellhead assembly according to claim 1 wherein the upper guide member is rotatable relative to the tree, and the lower guide member is fixed relative to the tubing hanger, so that as the upper guide member moves downward into engagement with the lower guide member, the guide slot and the guide key cause rotation of the upper guide member relative to the tree.

3. The wellhead assembly according to claim 1 wherein:

the upper guide member is rotatable and downwardly movable relative to the tree; and the lower guide member is fixed relative to the tubing hanger, allowing the tree to land on the wellhead housing, then the upper guide member to be moved downward into engagement with the lower guide member, the guide slot and the guide key causing rotation of the upper guide member relative to the tree.

4. The wellhead assembly according to claim 1 wherein the helical guide slot is formed in the upper guide member and the guide key is located on the lower guide member.

5. The wellhead assembly according to claim 1 wherein the tubing hanger has a production bore located on the longitudinal axis of the tubing hanger and the tree has a tubular stinger which depends from the lower end of the tree and engages the production bore.

6. The wellhead assembly according to claim 1 wherein the upper guide member is rotatable relative to the tree and movable between an upper retracted position and a lower extended position; and wherein the wellhead assembly further comprises:

actuator means, hydraulically actuated after the tree has landed on the wellhead housing, for moving the upper guide member downward to the extended position into engagement with the lower guide member, the guide slot and the guide key causing rotation of the upper guide member relative to the tree.

7. In a subsea well assembly having a subsea wellhead housing, a tubing hanger landed within the housing and having a production bore located on a longitudinal axis of the tubing hanger and wellhead housing, and at least one tubing hanger electrical connector located on an upper end of the tubing hanger and offset from the production bore, a tree which mounts to an upper end of the wellhead housing and has a depending tubular stinger which stabs into the production bore, the improvement comprising:

an upper guide member having an upper portion having a hole therethrough and a lower portion depending downward from the upper portion, the upper guide member being carried on a lower end of the tree with the stinger extending through the hole in the upper portion, the upper guide member being rotatable relative to the tree and movable relative to the tree between an upper retracted position and a lower extended position;

at least one tree electrical connector mounted to the upper portion of the upper guide member, offset from the stinger and protruding downward;

a lower guide member mounted to the tubing hanger;

a helical guide slot formed in one of the guide members;

a guide key located on the other guide member for engaging the guide slot; and actuator means, operable after the tree has landed on the wellhead housing, for moving the upper guide member downward from the upper retracted position to the lower extended position into engagement with the lower guide member and the tree electrical connector into engagement with the tubing hanger electrical connector, the guide slot and guide key causing the upper guide member to rotate to orient the tree electrical connector with the tubing hanger electrical connector during the downward movement.

8. The wellhead assembly according to claim 7 wherein the actuator means comprises:

at least one hydraulically actuated piston mounted in the tree.

9. The wellhead assembly according to claim 7 wherein the actuator means comprises:

at least one hydraulically actuated piston mounted in the tree for axial but nonrotatable movement relative to the tree in response to hydraulic fluid pressure supplied to the piston; and bearing means between the upper portion of the upper guide member and the piston for allowing relative rotation between the piston and the upper guide member as downward movement of the piston causes the bearing means to push the upper guide member downward.

10. The wellhead assembly according to claim 7 wherein the actuator means comprises:

a plurality of hydraulically actuated pistons mounted in piston bores formed in the tree and spaced around the stinger for axial movement relative to the tree in response to hydraulic fluid pressure supplied to the pistons;

a piston rod mounted to each piston and extending downward; and a roller bearing mounted to each piston rod for rotatably engaging the upper portion of the upper guide member to allow relative rotation between the pistons and the upper guide member as downward movement of the pistons causes the roller bearings to push the upper guide member downward.

11. The wellhead assembly according to claim 7 wherein the helical guide slot is formed in the upper guide member and the guide key is located on the lower guide member.

12. In a subsea well assembly having a subsea wellhead housing, the improvement comprising in combination:

a tubing hanger landed within the housing and having a production bore located on a longitudinal axis of the tubing hanger and wellhead housing;

at least one tubing hanger electrical connector located on an upper end of the tubing hanger and offset from the production bore;

a lower guide member rigidly mounted to the tubing hanger, the lower guide member having at least one guide key;

a tree which mounts to an upper end of the wellhead housing;

a tubular stinger mounted to a lower end of the tree and depending downward, the stinger stabbing into the production bore as the tree lands on the wellhead housing;

an upper guide member having an upper plate portion having a hole therethrough and a lower sleeve portion depending downward from the upper portion, the upper guide member being carried on a lower end of the tree with the stinger extending through the hole in the upper plate portion, the upper guide member being rotatable relative to the tree and the stinger and movable relative to the tree and the stinger between an upper retracted position and a lower extended position;

at least one tree electrical connector mounted to the upper plate portion of the upper guide member, offset from the stinger and protruding downward;

the lower sleeve portion of the upper guide member having a helical guide slot formed therein; and actuator means carried by the tree and operable after the tree has landed on the wellhead housing, for moving the upper guide member downward to the lower extended position into engagement with the lower guide member and the tree electrical connector into engagement with the tubing hanger electrical connector, the guide slot and guide key causing the upper guide member to rotate to orient the tree electrical connector with the tubing hanger electrical connector during the downward movement.

13. The wellhead assembly according to claim 12 wherein the actuator means comprises:

at least one hydraulically actuated piston carried in the tree for axial but nonrotatable movement relative to the tree in response to hydraulic fluid pressure supplied to the piston; and bearing means between the upper plate portion of the upper guide member and the piston for allowing relative rotation between the piston and the upper guide member as downward movement of the piston causes the bearing means to push the upper guide member downward.

14. The wellhead assembly according to claim 12 wherein the actuator means comprises:

a plurality of hydraulically actuated pistons mounted in piston bores formed in the tree and spaced around the stinger for axial movement relative to the tree in response to hydraulic fluid pressure supplied to the pistons;

a piston rod mounted to each piston and extending downward; and a roller bearing mounted to each piston rod for engaging the upper plate portion of the upper guide member to allow relative rotation between the pistons and the upper guide member as downward movement of the pistons causes the roller bearings to push the upper guide member downward.

15. A method for landing a subsea tree on a subsea wellhead housing which has a tubing hanger landed within the housing, and at least one tubing hanger electrical connector located on an upper end of the tubing hanger and offset from a longitudinal axis of the tubing hanger, the method comprising:

mounting an upper guide member to a lower end of the tree;

mounting at least one tree electrical connector to the upper guide member, offset from a longitudinal axis of the tree and protruding downward;

mounting a lower guide member to the tubing hanger;

providing a helical guide slot in one of the guide members and a guide key on the other guide member; then lowering the tree onto the we 11head housing and lowering the upper guide member into engagement with the lower guide member, causing the guide slot to rotate the upper guide member to orient the tree electrical connector with the tubing hanger electrical connector.

16. The method according to claim 15, wherein the step of mounting an upper guide member to a lower end of the tree comprises mounting the upper guide member rotatably to the lower end of the tree, so that the upper guide member rotates relative to the tree as it is lowered into engagement with the lower guide member.

17. The method according to claim 15, wherein the step of mounting an upper guide member to a lower end of the tree comprises mounting the upper guide member rotatably to the lower end of the tree and for axial movement relative to the tree, so that the upper guide member rotates and moves downward relative to the tree as it is lowered into engagement with the lower guide member.

18. The method according to claim 15 wherein the tree is lowered onto the wellhead housing without regard to orientation relative to the tubing hanger.

19. The method according to claim 15, wherein:

the step of mounting an upper guide member to a lower end of the tree comprises mounting the upper guide member rotatably to the lower end of the tree for axial movement relative to the tree; and wherein the step of lowering the upper guide member into engagement with the lower guide member is performed after the tree has landed on the wellhead housing.

20. A method for installing a tubing hanger and tree on a subsea wellhead housing, comprising:

mounting to the tubing hanger at least one tubing hanger electrical connector offset from a longitudinal axis of the tubing hanger;

mounting a lower guide member to the tubing hanger; mounting an upper guide member to a lower end of the tree for axial movement relative to the tree between an upper retracted position and a lower extended position and for rotational movement relative to the tree;

mounting at least one tree electrical connector mounted to the upper guide member, offset from a longitudinal axis of the tree and protruding downward;

providing a helical guide slot in one of the guide members and a guide key on the other guide member; then lowering the tubing hanger into the wellhead housing and securing the tubing hanger without regard to orientation;

lowering the tree onto the wellhead housing without regard to orientation while the upper guide member is in the retracted position; then moving the upper guide member downward to the extended position into engagement with the lower guide member, causing the guide slot to orient the tree electrical connector with the tubing hanger electrical connector by rotation of the upper guide member relative to the lower guide member.

21. In a subsea well assembly having a subsea wellhead housing, a tubing hanger assembly landed within the wellhead housing and having a production bore located on a longitudinal axis of the wellhead housing and tubing hanger assembly, a tree which mounts to an upper end of the wellhead housing and has a tubular stinger depending from a lower end that engages the production bore as the tree lands on the wellhead housing, the improvement comprising:

an annular valve chamber in the tubing hanger assembly, having inner and outer walls and surrounding the production bore, the inner and outer walls each having tapered sealing areas that converge toward each other;

a lower annulus passage offset from the production bore and extending upward from a lower end of the tubing hanger assembly to the valve chamber;

an upper annulus passage offset from the production bore and extending downward from an upper end of the tubing hanger assembly to the valve chamber;

a valve sleeve mounted in the valve chamber and axially movable from a closed position, blocking flow from the lower annulus passage to the upper annulus passage, to an open position, allowing flow from the lower annulus passage to the upper annulus passage;

metal inner and outer lips formed on an end of the valve sleeve in sliding engagement with the inner and outer walls, respectively, so as to seal against the tapered sealing areas to block flow from the lower annulus passage to the upper annulus passage when the valve sleeve is in the closed position; and hydraulic passage means in the stinger and tubing hanger assembly for supplying hydraulic fluid pressure to move the valve sleeve from the closed position to the open position.

22. The well assembly according to claim 21, further comprising:

spring means for biasing the valve sleeve to the closed position.

23. The well assembly according to claim 21, wherein the inner and outer seal lips deflect toward each other when the valve sleeve is moved to the closed position.

24. The well assembly according to claim 21, wherein the inner and outer seal lips are located on a lower end of the valve sleeve.

25. The well assembly according to claim 21, wherein:

the inner and outer seal lips are located on a lower end of the valve sleeve; and the inner and outer seal lips are located above a function of the upper annulus passage with the valve chamber when the valve sleeve is in the open position, and located below said junction when the valve sleeve is in the closed position.

* * * * *

UNITED STATES PATENT AND TRADEMARK OFFICE

CERTIFICATE OF CORRECTION

PATENT NO. : 5,503,230

DATED : 04/02/96

INVENTOR(S) : John H. Osborne, Brett R. McConaughy, Robert O. Lilley, Norman Brammer, Kenneth C. Davidson It is certified that error appears in the above-indentified patent and that said Letters Patent is hereby corrected as shown below:

Column 6, Line 38, before "lower" insert --a--;

Column 9, Line 37, "wellhead" should be --wellhead--.

Signed and Sealed this

Twenty-fifth Day of February, 1997

*Attest:*

*Attesting Officer*

BRUCE LEHMAN

*Commissioner of Patents and Trademarks*